US007983016B2

(12) United States Patent
Akisada et al.

(10) Patent No.: US 7,983,016 B2
(45) Date of Patent: Jul. 19, 2011

(54) ELECTROSTATICALLY ATOMIZING DEVICE

(75) Inventors: Shousuke Akisada, Hikone (JP); Kenji Obata, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 324 days.

(21) Appl. No.: 12/301,599

(22) PCT Filed: May 22, 2007

(86) PCT No.: PCT/JP2007/060410

§ 371 (c)(1),
(2), (4) Date: Nov. 19, 2008

(87) PCT Pub. No.: WO2007/138920

PCT Pub. Date: Dec. 6, 2007

(65) Prior Publication Data

US 2009/0109594 A1 Apr. 30, 2009

(30) Foreign Application Priority Data

May 26, 2006 (JP) ..... 2006-147379

(51) Int. Cl.
*G03G 15/02* (2006.01)

(52) U.S. Cl. ..... 361/225; 361/226; 361/228

(58) Field of Classification Search ..... 361/228
See application file for complete search history.

(56) References Cited

U.S. PATENT DOCUMENTS

| | | | |
|---|---|---|---|
| 5,337,963 | A | 8/1994 | Noakes |
| 2008/0130189 | A1 | 6/2008 | Kobayashi et al. |
| 2009/0001200 | A1 | 1/2009 | Imahori et al. |

FOREIGN PATENT DOCUMENTS

| | | | |
|---|---|---|---|
| EP | 1733798 | * | 12/2006 |
| JP | 05-345156 | A | 12/1993 |
| JP | 2005-296753 | A | 10/2005 |
| WO | WO-2005/097338 | A1 | 10/2005 |
| WO | WO-2005/097339 | A1 | 10/2005 |

OTHER PUBLICATIONS

International Search Report for the Application No. PCT/JP2007/060410 mailed Sep. 4, 2007.

Notification of Reasons for Refusal for Application No. 2006-147379 from Japan Patent Office mailed Feb. 22, 2011.

* cited by examiner

*Primary Examiner* — Stephen W Jackson

*Assistant Examiner* — Terrence R Willoughby

(74) *Attorney, Agent, or Firm* — Cheng Law Group, PLLC

(57) ABSTRACT

An electrostatically atomizing device comprises an emitter electrode, an opposed electrode, cooling means for condensing water on the emitter electrode, and a high voltage source; and high voltage is applied to the condensed water so that minute water particles are discharged from a discharge end at a tip of the emitter electrode. The device comprises a controller for causing the charged minute water particles to be discharged stably. The controller has an initial control mode and a normal control mode. In the initial mode, the cooling means is controlled so as to cool the emitter electrode at a predetermined cooling rate. Once discharge current reaches into a predetermined target discharge current range, the cooling means is controlled by feedback control, on the basis of the value of the discharge current, in such a manner that the discharge current is kept within the target discharge current range.

10 Claims, 5 Drawing Sheets

ELECTROSTATICALLY ATOMIZING DEVICE

TECHNICAL FIELD

The present invention relates to an electrostatically atomizing device, and more particularly to an electrostatically atomizing device for generating nanometer-size mist.

BACKGROUND

Japanese Patent Application Laid-open No. H5-345156 discloses a conventional electrostatically atomizing device for generating charged minute water particles of nanometer order (nanometer-size mist). In the device, a high voltage is applied across an emitter electrode, supplied with water, and an opposed electrode, to induce Rayleigh breakup of the water held on the emitter electrode, thereby atomizing the water. The charged minute water particles thus obtained, long-lived and containing radicals, can diffuse in large amounts into a space. These water particles can thus act effectively on malodorous components adhered to indoor walls, clothing, or curtains, to deodorize the same.

However, the above device relies upon a water tank containing the water that is supplied to the emitter electrode by capillarity, and thus the user has to replenish the water tank. In order to obviate this procedure, there could be provided a heat-exchanging section for condensing water by cooling the surrounding air, such that the water condensed by the heat-exchanging section (condensed water) is supplied to the emitter electrode. This approach, however, is problematic in that it takes at least several minutes to condense water at the heat-exchanging section and to feed the condensed water to the emitter electrode.

If water for electrostatic atomizing could be formed, as condensed water, on the emitter electrode by cooling the latter, there would be no need for water to be supplied to the emitter electrode. This approach, however, involves problems as regards emitter electrode cooling. If the emitter electrode cools excessively, excessive condensed water may adhere to the emitter electrode, while insufficient emitter electrode cooling may prevent condensed water from forming on the emitter electrode, precluding atomization as a result.

Since the discharge voltage is constant, more condensed water implies a greater discharge current, while less condensed water implies a reduction in discharge current. Therefore, an appropriate amount of condensed water can be ensured at all times on the emitter electrode by monitoring the discharge current and by adjusting the degree of cooling of a cooling means in accordance with the discharge current value. When such control is performed also during the time that it takes for condensed water to form on the emitter electrode, however, there arise problems in that control may be impossible, or in that hardly any condensed water forms on the emitter electrode.

DISCLOSURE OF THE INVENTION

In the light of the above problems of conventional art, it is an object of the present invention to provide an electrostatically atomizing device that requires no water replenishing means, and that allows preserving stable discharge conditions for generating a nanometer-size mist.

The electrostatically atomizing device of the present invention comprises an emitter electrode; an opposed electrode disposed in an opposed relation to the emitter electrode; cooling means for condensing water on the emitter electrode from within a surrounding air; and a high voltage source for applying high voltage between the emitter electrode and the opposed electrode. High voltage is applied to the condensed water, which becomes electrostatically charged thereby, so that minute water particles are discharged from a discharge end at the tip of the emitter electrode. The device comprises a controller for causing the charged minute water particles to be ejected stably, the controller having an initial control mode and a normal control mode. The normal control mode is operative in conditions under which an appropriate amount of condensed water is formed on the emitter electrode. The amount of condensed water on the emitter electrode is adjusted by monitoring the current flowing between the emitter electrode and the opposed electrode, and by controlling the degree of cooling of the emitter electrode, by way of the cooling means, in accordance with the discharge current. The discharge current varies in direct proportion to the amount of charged minute particles of water ejected from the emitter electrode. Therefore, the amount of charged minute particles of water ejected from the emitter electrode can be optimally adjusted by performing control in such a manner that the discharge current becomes constant. Accordingly, the controller has a target discharge current range, of predetermined width, around a predetermined target discharge current. The controller controls the cooling means in such a manner that the discharge current lies within the target discharge current range. The initial control mode sets in immediately after startup and lasts until an appropriate amount of condensed water is formed on the emitter electrode, i.e. the initial control mode is operative until the discharge current lies within the target discharge current range. In the initial control mode, the cooling means is controlled so as to cool the emitter electrode at a predetermined cooling rate. Cooling thus the emitter electrode at a predetermined cooling rate, until the discharge current reaches a predetermined target discharge current range, allows preventing formation of excessive condensed water through excessive cooling of the emitter electrode on account of delay in the cooling control of the cooling means, arising from the heat capacity of the emitter electrode, as is the case when, during startup, there is executed the normal control mode, in which the temperature of the emitter electrode is controlled on the basis of the discharge current. Thereafter, cooling can be controlled stably when switching to the normal control mode. Nanometer-size charged minute particles can thus be generated by forming at all times an appropriate amount of condensed water on the emitter electrode.

Preferably, the controller is configured to execute the normal control mode when the discharge current reaches first into the target discharge current range and satisfies a predetermined condition.

One such predetermined condition is defined such that, when the discharge current reaches first into the target discharge current range, the controller controls the cooling means so as to maintain a temperature of the emitter electrode for a fixed time interval, during which the discharge current is held within the target discharge current range.

Another condition is defined such that, when the discharge current reaches first into the target discharge current range, the controller controls the cooling means so as to maintain a temperature of the emitter electrode for a fixed time interval during which the discharge current exceeds a maximum of the target discharge current range. Once lying within the target discharge current range, the discharge current exceeds thus the maximum value of the target discharge current, without further cooling control of the emitter electrode. The controller, expecting that a sufficient amount of condensed water has formed on the emitter electrode, moves at once onto the normal control mode, and eases the cooling capacity of the cooling means, thereby affording stable control in which condensed water is prevented from forming in an excessive amount.

Yet another condition is defined such that, when the discharge current reaches first into the target discharge current range, the controller controls the cooling means for keeping a temperature of the emitter electrode for a fixed time interval, during which the discharge current is lower than a minimum of the target discharge current range, and the cooling means operates at is maximum efficiency. The cooling capacity in the cooling means is thus maximum, and although there may be some less condensed water on the emitter electrode in the present environment, an appropriate amount of condensed water can be expected to be obtained if the environment changes. Accordingly, the cooling capacity of the cooling means can be adjusted in accordance with a changed environment when the environment is changed so as to be suitable for condensed water generation, through switchover of the controller to the normal control mode.

A further yet another condition is defined such that, after an elapse of a time period from when the discharge current is determined to be out of the target discharge current range, the discharge current becomes smaller than the target current and at the same time the cooling means operates at its maximum efficiency. In this case as well, nanometer-size charged minute particles can be stably generated by ensuring an adequate amount of condensed water, by appropriately adjusting the cooling capacity of the cooling means, in response to the environment, when the environment changes to be suitable for condensed water generation.

Preferably, the controller of the electrostatically atomizing device of the present invention is configured to stop the cooling means provided that the discharge current is larger than the target discharge current and at the same time the cooling means operates at its maximum efficiency after an elapse of a predetermined period from when the discharge current is determined to be out of the target discharge current range. Specifically, when the current exceeds a target current value, with the emitter electrode being cooled to the maximum, the controller, expecting that discharge is being carried out with little condensed water, discontinues temporarily application of voltage to the Peltier module or the operation of the electrostatically atomizing device, and waits until the environment reverts to an environment that favors obtaining condensed water.

In the absence of this preventive measure, the process may move onto the normal control mode with insufficient condensed water, in which case the discharge current is large and, in consequence control is performed to lower the voltage applied to the Peltier module in such a manner so as to reduce the condensed water, which precludes performing control stably. By providing this preventive measure, therefore, an appropriate amount of condensed water can be formed on the emitter electrode before switchover to the normal control mode. Thereafter, in the normal control mode, it becomes possible to stably perform feedback control of the cooling capacity of the cooling means on the basis of the discharge current.

BEST MODE FOR CARRYING OUT THE INVENTION

Figure 1:
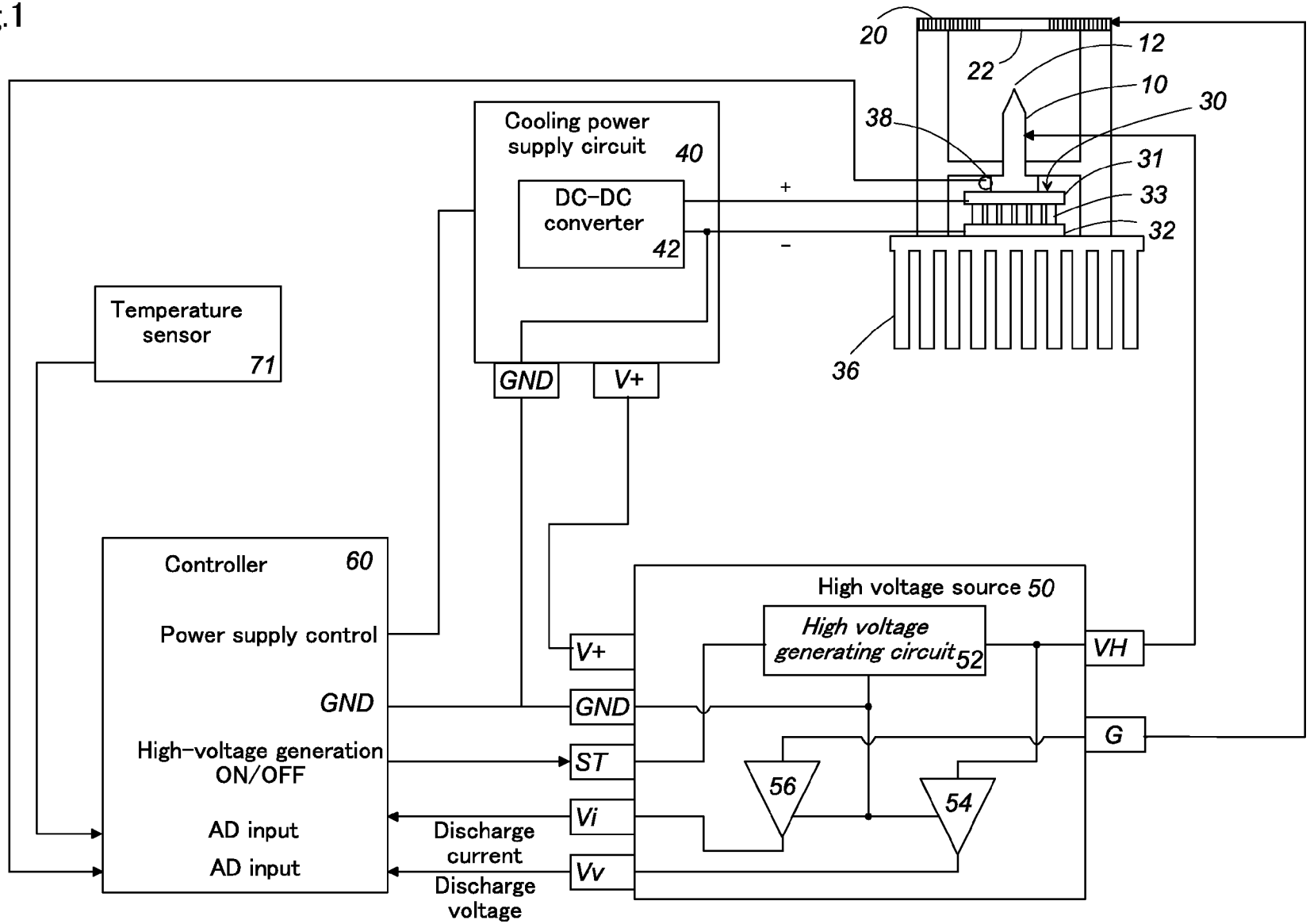
FIG. 1 is a block diagram of an electrostatically atomizing device according to the present invention.

An electrostatically atomizing device according to a preferred embodiment of the present invention is explained next with reference to accompanying drawings. As illustrated in FIG. 1, the electrostatically atomizing device comprises an emitter electrode 10 and an opposed electrode 20 disposed opposite the emitter electrode 10. The opposed electrode 20 comprises a circular hole 22 formed on a substrate made of a conductive material. The inner peripheral edge of the circular hole stands at a predetermined distance from a discharge end 12 at the tip of the emitter electrode 10. The device comprises a high voltage source 50 and a cooling means 30 coupled to the emitter electrode 10, for cooling the latter. The cooling means supplies water to the emitter electrode 10 by cooling the emitter electrode 10, causing thereby water vapor contained in the surrounding air to condense on the emitter electrode 10. Meanwhile, the high voltage source 50 applies high voltage between the emitter electrode 10 and the opposed electrode 20, thereby electrostatically charging the water on the emitter electrode 10 and causing water to be atomized, out of the discharge end, as charged minute particles.

The cooling means 30 comprises a Peltier module. The cooling side of the Peltier module is coupled to the end of the emitter electrode 10. The end of the emitter electrode 10 is located on the opposite side to the discharge end 12. Applying a predetermined voltage to the thermoelectric elements of the Peltier module causes the emitter electrode to be cooled to a temperature not higher than the dew point of water. The Peltier module comprises a plurality of thermoelectric elements 33 connected in parallel, between heat conductors 31, 32. The Peltier module cools the emitter electrode 10 at a cooling rate that is determined by a variable voltage applied by a cooling power supply circuit 40. One heat conductor 31, the one at the cooling side, is coupled to the emitter electrode 10, while the other heat conductor 32, the one at the heat radiating side, has formed thereon heat radiating fins 36. The Peltier module is provided with a thermistor 38 for detecting the temperature of the emitter electrode 10.

The high voltage source 50 comprises a high voltage generating circuit 52, a voltage detection circuit 54 and a current detection circuit 56. The high voltage generating circuit 52 applies a predetermined high voltage between the emitter electrode 10 and the opposed electrode 20 which is grounded. The high voltage generating circuit 52 applies a negative or positive voltage (for instance, −4.6 kV) to the emitter electrode 10. The voltage detection circuit 54 detects the voltage applied between both electrodes, while the current detection circuit 56 detects the discharge current flowing between both electrodes.

Figure 2:
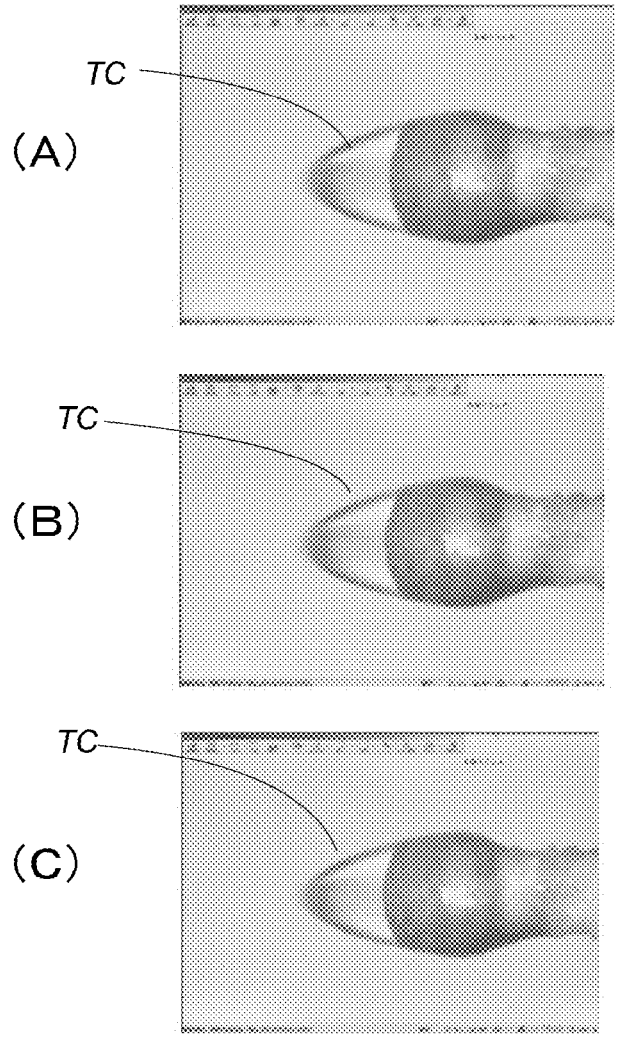
FIGS. 2(A), (B), (C) are explanatory diagrams illustrating the Taylor cones formed at the tip of an emitter electrode in the device.
Figure 3:
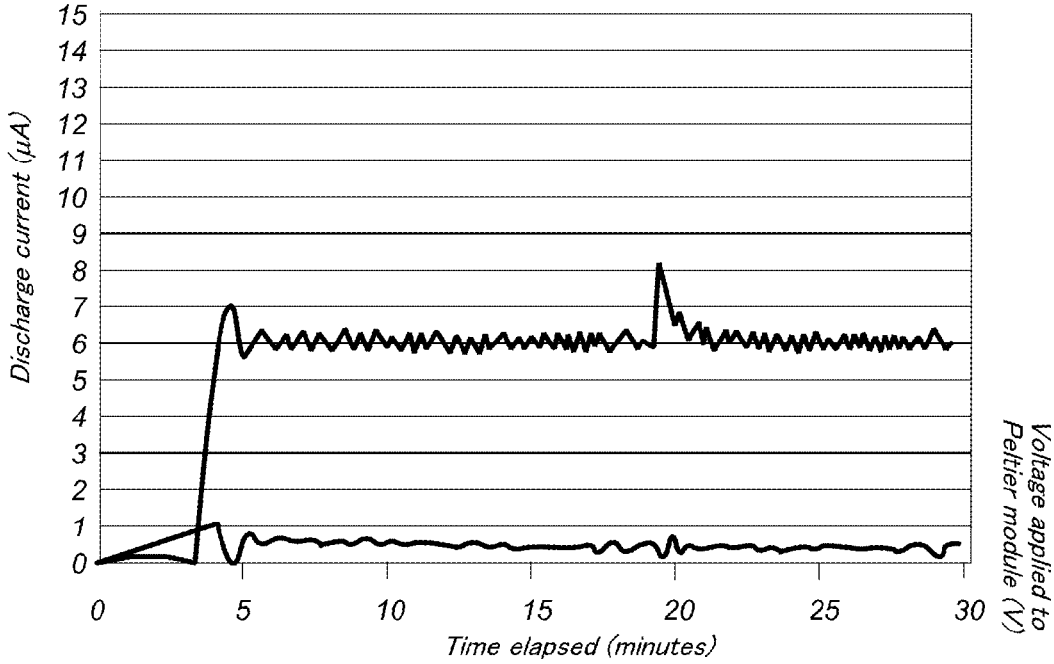
FIG. 3 is a block diagram illustrating discharge current and voltage applied to a Peltier module in the device.

The water supplied to the tip of the emitter electrode 10 forms droplets on account of surface tension. The high voltage generating circuit applies the high voltage to the emitter electrode 10 for generating the high-voltage field between the discharge end 12 and the opposed electrode 20. Consequently, the droplets is electrically charged by the high-voltage field. Thereupon, the droplets are ejected, from the tip of the emitter electrode, as a mist of negatively-charged minute water particles. When high voltage is applied between the emitter electrode 10 and the opposed electrode 20, Coulomb forces come into being between the water held at the discharge end 12 and the opposed electrode 20, whereupon a Taylor cone TC forms through local rising of the water surface, as illustrated in FIG. 2. Charge concentrates then at the tip of the Taylor cone TC, thereby increasing electric field strength in that section. The Coulomb forces generated in that area become greater as a result, causing the Taylor cone TC to grow further. When these Coulomb forces exceed the surface tension of water, the Taylor cone breaks apart (Rayleigh breakup) repeatedly, generating in the process a large amount of a mist of charged water minute particles having sizes in the nanometer scale. This mist rides the air stream, resulting from ion wind, that flows from the emitter electrode 10 towards the opposed electrode 20, and is ejected through the opposed electrode.

The above device further comprises a controller 60. The controller 60 regulates the cooling rate of the emitter electrode 10 by controlling the cooling power supply circuit 40, and turns on and off the voltage applied to the emitter electrode 10 by controlling the high voltage generating circuit 52. The cooling power supply circuit 40 comprises a DC-DC converter 42. The cooling capacity of the Peltier module is modified by changing the voltage applied to the Peltier module on the basis of a variable-duty PWM signal fed from the controller 60. The controller 60 is connected to a temperature sensor 71 for detecting the temperature of the indoor environment in which the electrostatically atomizing device is connected to ground. The controller 60 regulates the cooling temperature of the emitter electrode 10 in accordance with the environment temperature. The temperature sensor 71 is disposed on the outer housing of the electrostatically atomizing device, or on the housing of devices, for instance the housing of an air purifier, that are built into the electrostatically atomizing device.

The controller 60 comprises two operation modes. One operation mode is an initial control mode that is executed immediately after device start-up, and the other is a normal control mode, which comes into operation thereafter. In the initial cooling control mode, the controller 60 applies high voltage to the emitter electrode 10 while increasing the voltage applied to the Peltier module by a given fraction, cooling the emitter electrode 10 at a corresponding predetermined cooling rate and causing thereby water to condense on the emitter electrode 10. In the normal control mode, the controller 60 applies high voltage to the emitter electrode 10 while maintaining such an amount of water on the emitter electrode 10 as to yield nanometer-size charged minute particles, by keeping the discharge current within a predetermined range through variations in the voltage applied to the Peltier module, on the basis of changes in the detected discharge current.

In order to stably generate nanometer-size charged minute particles, a Taylor cone TC of appropriate size must form at the tip of the emitter electrode 10, as illustrated in FIG. 2(B). The size of the Taylor cone TC can be determined on the basis of the discharge current flowing between the emitter electrode and the opposed electrode. A discharge current of, for instance, 6.0 μA results in the formation of a Taylor cone TC of a size suitable for generating nanometer-size charged minute particles, as illustrated in FIG. 2(B). When the size of the Taylor cone TC is smaller or larger than the above size, as illustrated in FIGS. 2(A) and (C), the water on the emitter electrode becomes scant or excessive, thereby precluding stable generation of nanometer-size charged minute particles. The value of the discharge current in those cases is 3.0 μA and 9.0 μA.

In the normal control mode, the controller 60 controls cooling of the Peltier module on the basis of the detected discharge current, whereby the Taylor cone TC is kept at an appropriate size such that nanometer-size charged minute particles are generated stably. Before moving onto the normal control mode, the controller 60 executes the initial control mode in which the Peltier module is controlled without referring to the discharge current. As a result, the emitter electrode 10 is cooled comparatively gently, thereby preventing the formation of an excessive amount of water.

The initial control mode will be explained first.

After start-up, the controller 60 increases the voltage applied to the Peltier module at a predetermined rate (Vp (V/sec)), for instance 0.01 V/sec, from 0 V, while detecting the discharge current at fixed intervals of time, to check thereby whether or not the detected discharge current falls within a target discharge current range (target discharge current value ±A (μA)). The target discharge current value is set at, for instance, 6 μA, and the target discharge current range is set at 6±2 (μA). Changes in the discharge voltage are accompanied by changes in the discharge current value that denotes an appropriate amount of condensing water. Therefore, the optimal target discharge current value and the range thereof are set in accordance with the discharge voltage V(n), as in Table 1. The increments in the voltage applied to the Peltier module are selected arbitrarily in accordance with the volume of the emitter electrode 10 and the number of thermoelectric elements in the Peltier module, and are not limited to the values above.

TABLE 1

Target discharge current table

| | Target discharge current value | | |
|---|---|---|---|
| Discharge voltage V(n) | Lower limit (I(n)min) | Median ($I_{TGT}$) | Upper limit (I(n)max) |
| 4.1 ≦ V(n) < 4.2 | I1 − a1 | I1 | I1 + a1 |
| 4.2 ≦ V(n) < 4.3 | I2 − a2 | I2 | I2 + a2 |
| 4.3 ≦ V(n) < 4.4 | I3 − a3 | I3 | I3 + a3 |
| 4.4 ≦ V(n) < 4.5 | I4 − a4 | I4 | I4 + a4 |
| 4.5 ≦ V(n) < 4.6 | I5 − a5 | I5 | I5 + a5 |
| 4.6 ≦ V(n) < 4.7 | I6 − a6 | I6 | I6 + a6 |
| 4.7 ≦ V(n) < 4.8 | I7 − a7 | I7 | I7 + a7 |
| 4.8 ≦ V(n) < 4.9 | I8 − a8 | I8 | I8 + a8 |
| 4.9 ≦ V(n) < 5.0 | I9 − a9 | I9 | I9 + a9 |
| 5.0 ≦ V(n) < 5.1 | I10 − a10 | I10 | I10 + a10 |
| 5.1 ≦ V(n) < 5.2 | I11 − a11 | I11 | I11 + a11 |

Once the discharge current lies within a predetermined target discharge current range, the controller 60 moves onto the normal control mode, and controls the Peltier module in such a manner that the detected discharge current becomes the above-described target discharge current. In the present embodiment, further conditions are necessary for delivering stable operation when moving from the initial control mode to the normal control mode, as described below. These further conditions, however, may be made unnecessary.

The normal control mode will be explained next.

1) Determination of the Cooling Rate

Upon moving onto the normal control mode, the controller 60 reads the electrode temperature of the emitter electrode 10 by way of the thermistor 38, obtains a temperature difference ($\Delta T$) between a target electrode temperature ($T_{TGT}$) and the actual electrode temperature, and reads a target cooling rate, as a target duty, from a cooling rate table prepared beforehand, as given in Table 2 below. Herein, duty designates a ratio of voltage (%) applied to the Peltier module per unit time, such that the higher the duty the faster the cooling rate becomes. The equivalent duty D(n) values in the table result from dividing respective duties, ranging from 0 to 100%, by 256, such that D(96) corresponds to a 38% duty, and D(255) corresponds to a 99% duty. The Peltier module is cooled by PWM control using these equivalent duties.

TABLE 2

| Temperature difference ($\Delta T$) (=electrode temperature − target electrode temperature) | Target duty | Equivalent target duty D(n) |
|---|---|---|
| $0 \leqq \Delta T < 5$ | 1 | D(0) |
| $5 \leqq \Delta T < 7.5$ | 6.6 | D(16) |
| $7.5 \leqq \Delta T < 10$ | 14.5 | D(36) |
| $10 \leqq \Delta T < 12.5$ | 22.3 | D(56) |
| $12.5 \leqq \Delta T < 15$ | 30.1 | D(76) |
| $15 \leqq \Delta T < 17.5$ | 37.9 | D(96) |
| $17.5 \leqq \Delta T < 20$ | 53.5 | D(136) |
| $20 \leqq \Delta T < 22.5$ | 61.3 | D(156) |
| $22.5 \leqq \Delta T < 25$ | 69.1 | D(176) |
| $25 \leqq \Delta T < 27.5$ | 84.8 | D(216) |
| $27.5 \leqq \Delta T < 30$ | 99 (max) | D(255) |
| $30 \leqq \Delta T < 35$ | 99 (max) | D(255) |
| $35 \leqq \Delta T$ | 99 (max) | D(255) |

2) Discharge Voltage and Discharge Current Readout

Next, the controller 60 adds a predetermined duty correction $\Delta D$ to a target duty D, in order to keep the discharge current close to the target discharge current value. As explained below, this duty correction $\Delta D$ is determined on the basis of the discharge current and target discharge current value.

Figure 4:
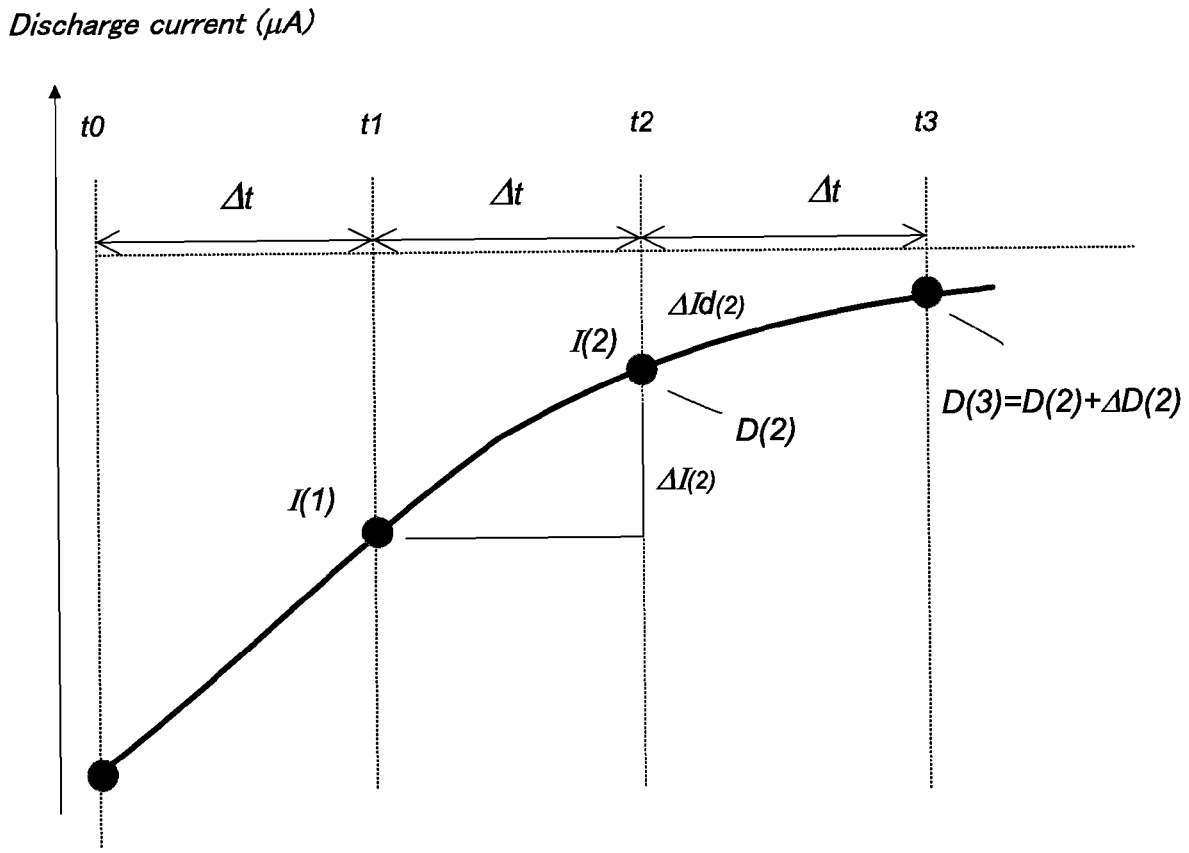
FIG. 4 is an explanatory diagram of the operation of the device in a normal control mode.

To calculate the duty correction $\Delta D$, the controller 60 starts reading the discharge voltage and the discharge current from the voltage detection circuit 54 and the current detection circuit 56, respectively, at time t0 immediately after the point in time at which the controller 60 enters the normal mode, and determines a first discharge voltage V(1) and a first discharge current I(1) at time t1 after a predetermined lapse of time $\Delta t$, as illustrated in FIG. 4. Herein, $\Delta t$ is set to 6.4 seconds, during which the discharge voltage and the discharge current are read every 0.32 seconds. The average values thereof are determined as V(1) and I(1).

3) Determination of Duty Correction $\Delta D$

Next, the controller 60 determines a second discharge current I(2) at time t2 after the predetermined lapse of time $\Delta t$, in the same manner as above, and works out the variation from the first to the second discharge current ($\Delta I(2)=I(2)-I(1)$). Also, the controller 60 reads, from the target discharge current table, the target discharge current value $I_{TGT}(1)$ that corresponds to the first discharge voltage V(1), and obtains a target discharge current error $\Delta Id(2)$ ($=I_{TGT}(1)-I(2)$) between the target discharge current value and the target discharge current at time t2. The controller 60 determines then the duty D(2), which denotes the cooling rate of the Peltier module at times t1 to t2, and the duty correction $\Delta D(2)$, on the basis of the variation $\Delta I(2)$ of discharge current determined at time t2 and the target discharge current error $\Delta Id$ in accordance with the formula below.

Equation 1

$$\Delta D(2)=a\times\Delta Id(2)-b\times\Delta I(2) \quad \text{(formula 1)}$$

In the formula, a and b are constants (=0.3).

On the basis of the above formula, the controller 60 determines the duty D(3) ($=D(2)+\Delta D(2)$) up to time t3 after a predetermined time $\Delta t$ has elapsed from time t2, and cools the emitter electrode 10 by controlling the Peltier module at the cooling rate denoted by D(3). As described above, D(2) is determined on the basis of the environment temperature and the electrode temperature at that point in time.

The same control is performed thereafter every predetermined time $\Delta t$, to modify $\Delta D$ in such a manner that that the discharge current value approaches the target discharge current value. In this continued feedback control, the duty increases $\Delta D(n)$, the target discharge current error $\Delta Id(n)$ and the discharge current variation $\Delta I(n)$ between two consecutive points in time are given by formulas 2, 3 and 4 below.

Equation 2

$$\Delta D(n)=a\times\Delta Id(n)-b\times\Delta I(n) \quad \text{(formula 2)}$$

Equation 3

$$\Delta Id(n)=I_{TGT}(n-1)-I(n) \quad \text{(formula 3)}$$

Equation 4

$$\Delta I(n)=I(n)-I(n-1) \quad \text{(formula 4)}$$

In the formulas, I(n) is the n-th discharge current value after discharge start and $I_{TGT}(n-1)$ is the (n−1)th target discharge current value calculated from the discharge voltage.

The temperature of the emitter electrode 10 is thus feedback-controlled by monitoring the discharge current. Thereby, the amount of condensed water on the emitter electrode 10 is kept at all times suitable for generating nanometer-size mist. As a result, electrostatic atomizing for generating nanometer-size mist by discharge can proceed continuously, without any breaks.

Figure 6:
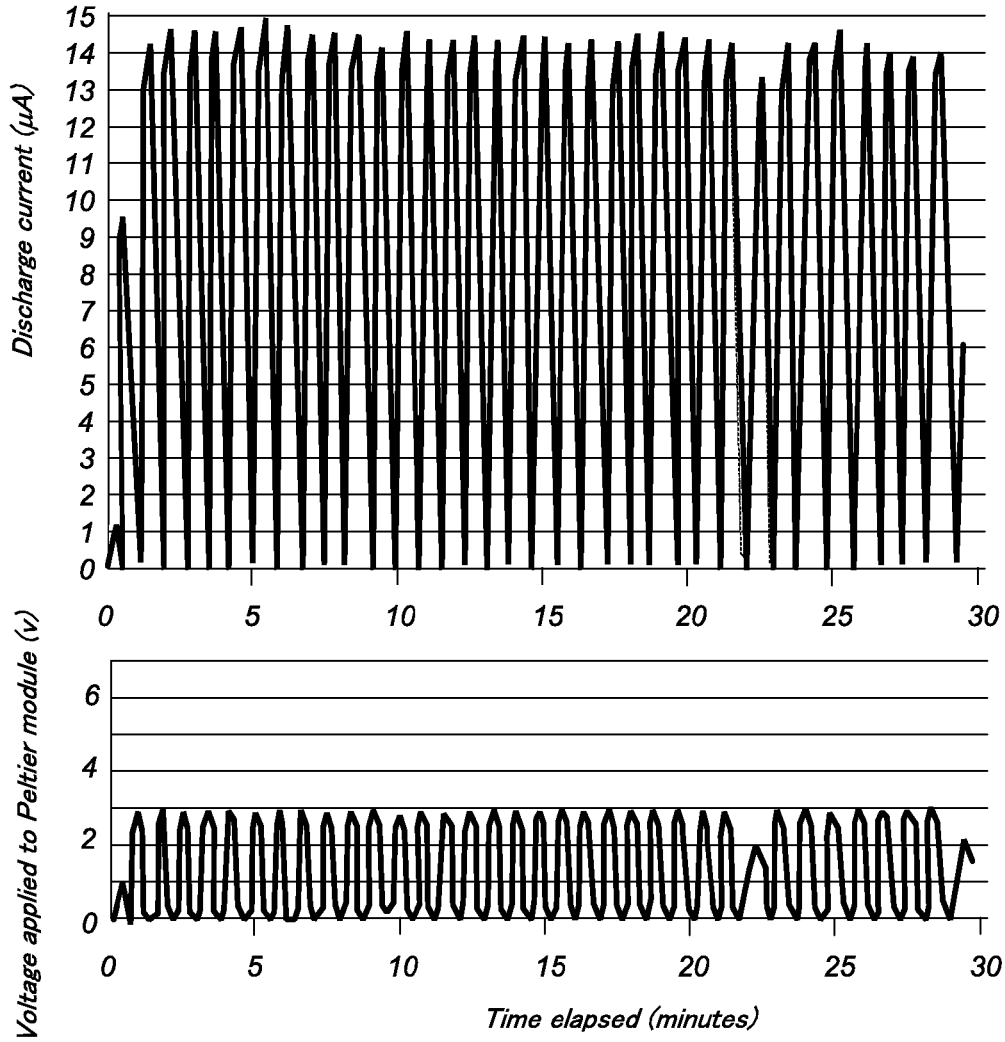
FIG. 6 is a graph diagram illustrating an example of undesired discharge current and voltage applied to a Peltier module as observed during startup.

Unlike in the normal control mode, feedback control of the cooling capacity of the Peltier module on the basis of discharge current is not carried out in the initial control mode. In the initial control mode, the voltage applied to the Peltier module is raised by a given fraction to cool the emitter electrode at a predetermined cooling rate, the initial control mode moving onto normal control mode once the discharge current falls within a predetermined current range. In the initial control mode, thus, the emitter electrode 10 is cooled at a comparatively low cooling rate to generate an appropriate amount of condensed water on the emitter electrode 10, after which the normal control mode is executed. The normal control mode, therefore, starts from feedback control on the basis of a discharge current having a value close to the target discharge current, so that cooling is controlled in a stable manner, without abrupt voltage changes in the Peltier module, i.e. without forcing abrupt cooling rate changes in the emitter electrode. Nanometer-size mist can thus be generated stably. If, by contrast, the normal control mode is performed immediately after startup, the discharge current is controlled so as to approach a target discharge current value, from a state of zero discharge current, such that a large cooling rate is set from the start, and the emitter electrode cools excessively as a result. This situation persists for a predetermined time on account of the delay of the feedback system, whereupon excessive condensation water forms on the emitter electrode. As a result, the situation illustrated in FIG. 6, in which the applied voltage in the Peltier module is large and the discharge current is likewise large, drags on for quite some time. It takes then a long time to revert to a stabilized control in which the discharge current is held within a predetermined target discharge current range.

Figure 5:
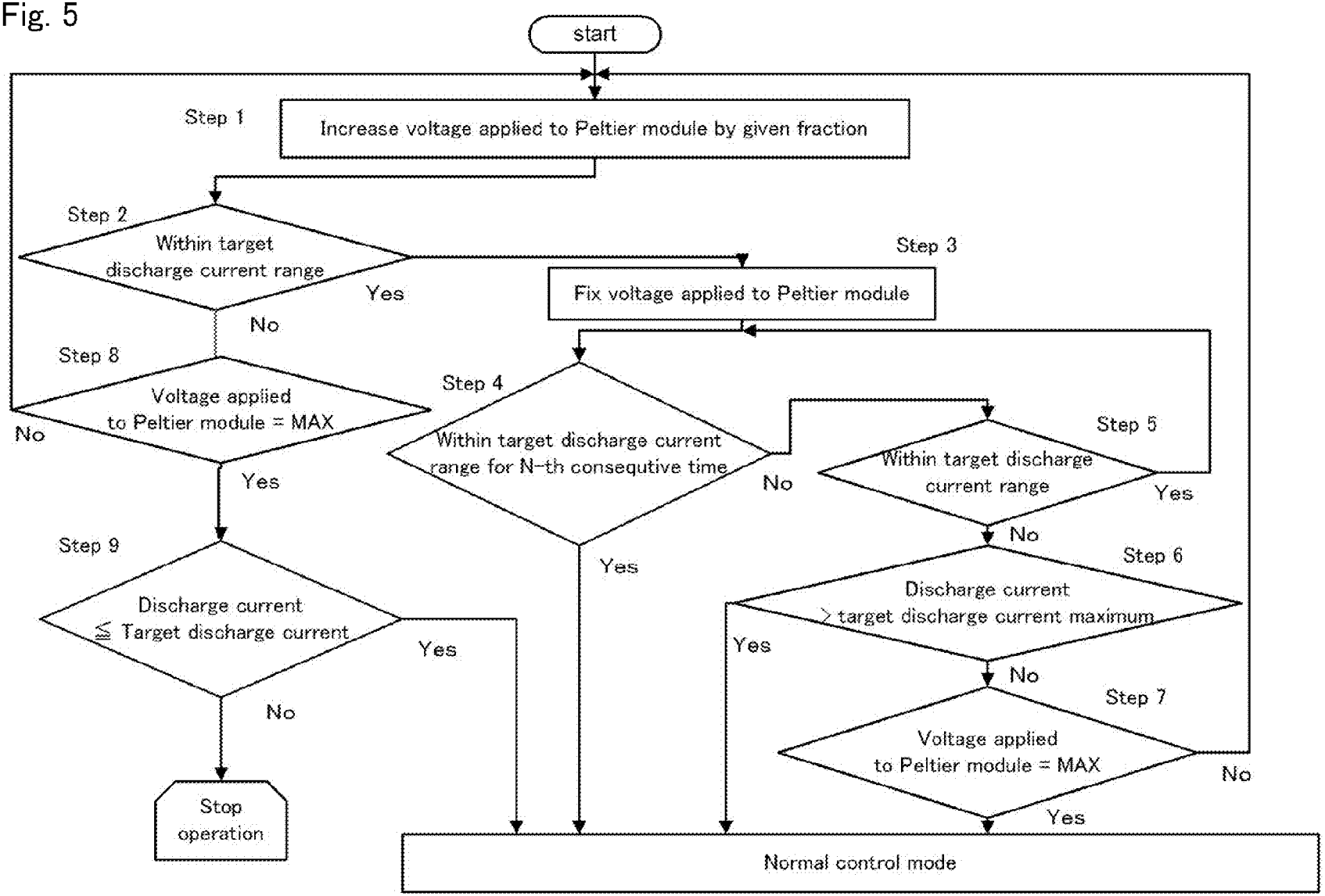
FIG. 5 is a flowchart for explaining the operation of the device in an initial control mode.

In the present embodiment, the transition from the initial control mode to the normal control mode takes place when predefined conditions are satisfied once the discharge current reaches first into a predetermined target discharge current range. The details are explained with reference to the flowchart of FIG. 5. From the moment that application of voltage to the Peltier module starts, the controller 60 detects the discharge current at premed time intervals and detects whether the voltage applied to the Peltier module has risen up to a predetermined allowable maximum voltage. In step 1, every time that the voltage applied to the Peltier module is increased by a given fraction (duty increase ΔD) it is determined whether the discharge current has reached into a predetermined target discharge current range (step 2). When the controller 60 determines that the discharge current has reached first into a predetermined target discharge current range, the controller 60 fixes the voltage applied to the Peltier module to the present value. The controller 60 determines whether after consecutive N times (N>1) the detected discharge current lies within the target discharge current range (step 4). The controller 60 initiates the normal control mode if the discharge current after consecutive N times lies within the target discharge current range. Otherwise, the controller 60 re-reads the discharge current and checks whether the discharge current lies within the target discharge current range (step 5), and returns to the step 4 if the discharge current lies within the target discharge current range. When the discharge current lies outside the target current range at this point in time, the controller 60 checks, in step 6, whether the discharge current exceeds a maximum value of the target discharge current range. If the discharge current exceeds the maximum value of the target discharge current, the controller 60 initiates the normal control mode. Once lying within the target discharge current range, the discharge current exceeds thus the maximum value of the target discharge current, without further cooling control of the emitter electrode, whereupon it is determined that a sufficient amount of condensed water has formed on the emitter electrode. As a result, the controller 60 moves at once onto the normal control mode, and eases cooling of the emitter electrode by lowering the voltage applied to the Peltier module, thereby affording stable control in which condensed water is prevented from forming in an excessive amount.

When in step 6 it is determined that the discharge current is smaller than the maximum value of the target discharge current, the controller 60 checks in step 7 whether the voltage applied to the Peltier module is a maximum allowable voltage (MAX). If the applied voltage is the maximum allowable voltage, the controller 60 initiates the normal control mode. Otherwise, the process returns to step 1, and the voltage applied to the Peltier module is increased further. When the voltage applied to the Peltier module is the maximum allowable voltage, the emitter electrode 10 is already cooled to the maximum. Therefore, although there may be now some less condensed water on the emitter electrode 10 in the present environment, an appropriate amount of condensed water can be expected to be obtained if the environment changes. Accordingly, the controller 60 moves onto the normal control mode to adjust the cooling capacity of the Peltier module in accordance with the environment.

Meanwhile, in step 2, it is determined that the discharge current lies outside the target discharge current range, the controller 60 checks in step 8 whether the voltage applied to the Peltier module is the maximum allowable voltage (MAX). If the applied voltage is not the maximum allowable voltage, the process returns to step 1, and the voltage applied to the Peltier module is increased further. If the applied voltage is the maximum allowable voltage, the controller 60 reads again the discharge current, and checks in step 9 whether the discharge current is smaller than the target discharge current value. If so, the controller 60 considers that the emitter electrode is cooled to the maximum under the present environment, and initiates the normal control mode. By contrast, when the current exceeds a target current value, with the emitter electrode being cooled to the maximum, the controller 60, expecting that discharge is being carried out with little condensed water, discontinues temporarily application of voltage to the Peltier module or the operation of the electrostatically atomizing device, and waits until the environment reverts to an environment that favors obtaining condensed water. In the absence of this preventive measure, the process may move onto the normal control mode with insufficient condensed water. The discharge current is then large and, in consequence, control is performed to lower the voltage applied to the Peltier module in such a manner so as to reduce the condensed water, which precludes performing control stably.

In the present embodiment, thus, the controller 60 stops increasing the voltage applied to the Peltier module at the point in time at which the discharge current reaches first into the target discharge current range, and maintains the temperature of the emitter electrode 10 for a given lapse of time during which the discharge current is detected over N or N+1 consecutive times. During that time, the controller 60 checks 1) whether the discharge current lies within the target discharge current range,
2) whether the discharge current value exceeds the maximum value of the target discharge current range,
3) whether the discharge current value is smaller than a minimum value of the target discharge current range and the Peltier module is operating at maximum capacity.

The controller 60 moves onto the normal control mode when any of these conditions is satisfied.

The controller 60 moves onto the normal control mode also when, after a predetermined time following a judgment to the effect that the discharge current lies outside the target discharge current range, the detected discharge current becomes smaller than the target discharge current and the Peltier module is operating at maximum cooling capacity at that time.

The invention claimed is:

1. An electrostatically atomizing device comprising:

an emitter electrode;

an opposed electrode disposed in an opposed relation to said emitter electrode;

cooling means configured to cool said emitter electrode in order to condense water on said emitter electrode from within a surrounding air;

a high voltage source configured to apply a high voltage between said emitter electrode and said opposed electrode in order to electrostatically charge the condensed water for discharging charged minute water particles from a discharge end at a tip of said emitter electrode; and a controller configured to monitor a discharge current flowing between the emitter electrode and the opposed electrode in order to control said cooling means based upon a discharge condition, wherein said controller is configured to provide a target discharge current range of a width covering a predetermined target discharge current, said controller is configured to provide an initial control mode and a normal control mode, said initial control mode being provided to control said cooling means for cooling said emitter electrode at a predetermined cooling rate until the discharge current reaches into said target discharge current range, said normal control mode being provided to make, after said discharge current reaches into said target discharge current range, a feedback control of controlling the cooling means based upon the monitored discharge current in order to keep the monitored discharge current within said target discharge current range, and wherein in the initial control mode, said controller applies the high voltage to the emitter electrode while cooling the emitter electrode, thereby causing the water to condense on the emitter electrode.

2. The electrostatically atomizing device as set forth in claim 1, wherein said controller is configured to execute said normal control mode when said discharge current reaches first into said target discharge current range and satisfies a predetermined condition.

3. The electrostatically atomizing device as set forth in claim 2, wherein said predetermined condition is defined such that, upon reaching of said discharge current first into said target discharge current range, said controller controls said cooling means for keeping a temperature of said emitter electrode for a fixed time interval, during which said discharge current is held within said target discharge current range.

4. The electrostatically atomizing device as set forth in claim 2, wherein said predetermined condition is defined such that, upon reaching of said discharge current first into said target discharge current range, said controller controls said cooling means for keeping a temperature of said emitter electrode for a fixed time interval during which said discharge current extends beyond a maximum of said target discharge current range.

5. The electrostatically atomizing device as set forth in claim 2, wherein said predetermined condition is defined such that, upon reaching of said discharge current first into said target discharge current range, said controller controls said cooling means for keeping a temperature of said emitter electrode for a fixed time interval, during which said discharge current is lower than a minimum of said target discharge current range, and said cooling means operates at is maximum efficiency.

6. The electrostatically atomizing device as set forth in claim 2, wherein said predetermined condition is defined such that, after an elapse of a time period from when the discharge current is determined to be out of said target discharge current range, the discharge current becomes smaller than said target current and at the same time said cooling means operates at its maximum efficiency.

7. The electrostatically atomizing device as set forth in claim 1, wherein said controller is configure to detect the following conditions of:

whether said controller controls, upon reaching of said discharge current first into said target discharge current range, said cooling means to keep a temperature of said emitter electrode for a fixed time interval during which said discharge current is within said target discharge current range;

whether said controller controls, upon reaching of said discharge current first into said target discharge current range, said cooling means to keep a temperature of said emitter electrode for a fixed time interval during which said discharge current extends beyond a maximum of said target discharge current range;

whether said controller controls, upon reaching of said discharge current first into said target discharge current range, said cooling means to keep a temperature of said emitter electrode for a fixed time interval during which said discharge current is lower than a minimum of said target discharge current range and said cooling means operates at its maximum efficiency; and whether, after an elapse of a time period from when the discharge current is determined to be out of said target discharge current range, the discharge current becomes smaller than said target current and at the same time said cooling means operates at its maximum efficiency, and wherein said controller is configured to shift said initial control mode to said normal control mode when any one of the above conditions is satisfied.

8. The electrostatically atomizing device as set forth in claim 1, wherein said controller is configured to stop said cooling means provided that the discharge current is larger than the target discharge current and at the same time said cooling means operates at its maximum efficiency after an elapse of a predetermined period from when said discharge current is determined to be out of said target discharge current range.

9. The electrostatically atomizing device as set forth in claim 1, wherein said controller is configured to execute said initial control mode immediately after said electrostatically atomizing device start-up.

10. The electrostaticaly atomizing device as set forth in claim 9, wherein said controller being configured to monitor the discharge current which flows between said emitter electrode and said opposed electrode immediately after said electrostatically atomizing device start-up.

* * * * *